US010400434B2

(12) United States Patent
Seimiya

(10) Patent No.: US 10,400,434 B2
(45) Date of Patent: Sep. 3, 2019

(54) VACUUM TOILET SYSTEM

(71) Applicants: Sadao Seimiya, Tokyo (JP); NIPPON DYNE-A-MAT CORP., Tokyo (JP)

(72) Inventor: Sadao Seimiya, Tokyo (JP)

(73) Assignees: Semilla Corporation, Tokyo (JP), part interest; Nippon Dyne-a-Mat Corp., Tokyo (JP), part interest ( * ) Notice: Subject to any disclaimer, the term of this patent is extended or adjusted under 35 U.S.C. 154(b) by 0 days.

(21) Appl. No.: 15/358,913

(22) Filed: Nov. 22, 2016

(65) Prior Publication Data

US 2017/0152657 A1 Jun. 1, 2017

(30) Foreign Application Priority Data

Dec. 1, 2015 (JP) ..... 2015-234500

(51) Int. Cl.
*E03F 1/00* (2006.01)

(52) U.S. Cl.
CPC ..... *E03F 1/006* (2013.01)

(58) Field of Classification Search
CPC ..... E03D 11/02; E03D 5/04; E03F 1/006
USPC ..... 4/431
See application file for complete search history.

(56) References Cited

U.S. PATENT DOCUMENTS

| | | | | |
|---|---|---|---|---|
| 2,849,727 | A * | 4/1956 | Bollinger et al. | 4/217 |
| D342,123 | S * | 12/1993 | Hampden | D23/311 |
| 5,326,069 | A | 7/1994 | Clear | |
| 7,690,053 | B2 | 4/2010 | Pondelick | |
| 7,976,600 | B1 * | 7/2011 | Safuto | 55/385.1 |
| 2006/0053541 | A1 * | 3/2006 | Howard | 4/431 |

FOREIGN PATENT DOCUMENTS

| | | |
|---|---|---|
| EP | 0363012 | 1/1994 |
| JP | 63-033896 | 3/1988 |
| JP | 02-167936 | 6/1990 |
| JP | 07-247587 | 9/1995 |
| JP | 1996-503035 | 4/1996 |
| JP | 2000-096668 | 4/2000 |
| JP | 2002-322722 A | 11/2002 |
| JP | 2005-296152 | 10/2005 |
| JP | 2008-002149 | 1/2008 |
| JP | 2008-546936 | 12/2008 |
| JP | 2010-037783 | 2/2010 |

* cited by examiner

*Primary Examiner* — Huyen D Le
(74) *Attorney, Agent, or Firm* — Ryder, Mazzeo & Konieczny LLC

(57) ABSTRACT

A vacuum toilet system having means to diminish stains generated on a lower surface of a shroud when flush is operated with lid closed. The toilet system is structured to make air flow easier into the bowl when lid is closed. The lid is provided with mesh, slit, or air scoop style openings. The system also provides a structure in which flush operation is triggered by detecting a predetermined inclining angle of the lid before it closes. Another aspect is that the lower surface of the shroud is curved for keeping shroud away from the upper surface around the bowl's rim. Another aspect is that the height of the shroud stays extending from the shroud's lower surface is higher compared to the prior art. The system also provides protrusions projecting upward from the bowl's upper surface opposite the shroud stays in a wavy configuration around the bowl's rim.

17 Claims, 4 Drawing Sheets

VACUUM TOILET SYSTEM

FIELD OF THE DISCLOSURE

This application claims the priority under 35 U.S.C. § 119 of Japanese Patent Application 2015-234500, filed on Dec. 1, 2015.

The present invention relates to a vacuum toilet system for flushing waste in the toilet bowl by means of vacuum sucking effect, and more specifically the present invention relates to a vacuum toilet system configured to flush waste by vacuum sucking in a condition of the bowl being closed by a lid of the toilet after the toilet is used.

BACKGROUND

A flushing toilet system known in the prior art was configured to flush waste by means of water utilizing gravity effect only. Contrary to this, a vacuum toilet system is configured to forcedly flush waste in the toilet bowl by utilizing vacuum pressure, e.g., Patent No. JP H8-503035 A (JP 1996-503035 A). Such a system has been used mainly for transportation vehicles such as aircrafts, ships, railroad cars, etc. because of its advantage of drastically reducing volume of flushing water to be used compared to conventional gravity flushing toilet system, or of its reduced size of pipes and connecting device to be used. In the future, such vacuum flushing toilet system may be used in a wider range of areas including household usage.

In the case of a vacuum toilet system, a bowl for receiving waste is connected to a waste pipe in a substantially lower pressure condition relative to the bowl, which in turn is connected to a waste collecting tank. Generally, a small amount of water is also supplied into the bowl in conjunction with the flushing operation for cleaning the bowl. In the case of transportation means, such as an aircraft, such used waste and flushing water are disposed to a sewage treatment route after the toilet is used for a certain period of time. In order to completely flush waste in the bowl, and deliver the same effectively through the waste pipe to the waste collecting tank, a predetermined level of vacuum pressure is required in the waste pipe. Normally, such vacuum pressure level is about 40 kPa lower than atmosphere (0.3-0.5 bar of pressure difference among them). A waste water valve is connected between the exit of the bowl and the waste pipe, so as to form the above pressure difference at the valve by means of a blower or an ejector. Such pressure difference may be generated by keeping the waste collecting tank in such vacuum pressure level, or creating such vacuum pressure in conjunction with the flushing operation at the bowl. In the case of an aircraft at high altitude, pressure difference between inside and outside of the aircraft can be used. When the waste water valve is actuated by operating a flushing button, waste in the bowl is almost instantaneously flushed into the waste water pipe, and then delivered into the waste collecting tank in a high speed through the waste water pipe.

As for a problem of the vacuum toilet system, it is known that the pipe is sometimes clogged due to sucking a variety of foreign stuffs, other than the waste, which are dropped into the bowl either accidentally or intentionally. Since such problem may turn into a serious issue, especially in the case of an aircraft, some technologies for easily eliminating such obstacles are open to the public, e.g., Patent No. JP 2002-322722 A. Other solutions are also known, such as automatically closing a lid of a toilet prior to flushing the waste, and then flushing (vacuum sucking) the waste afterward, e.g., Patent No. JP 2008-546936 A. In a specific embodiment of this solution, when a user operates the flushing button, a lever located behind the lid in an open position extends and pushes the lid to a certain level of angle, so that the lid may gradually move down toward a closed position by its own weight. When a censor detects that the lid is completely closed, the censor sends a signal so as to generate vacuum pressure for flushing the waste. Through such a solution, even when the user drops some foreign stuffs accidentally, it would not drop into the bowl. Such solution can also be considered as a safety measure, such as a case when the user is a small child.

SUMMARY OF THE INVENTION

However, such a solution for flushing waste after the lid is closed creates a new problem, which is a stain of the vacuum toilet system. Specifically, such stains are clearly visible in a hidden side of the shroud, especially in the areas around stays (projections), four of them generally disposed behind the shroud for making direct contact with the bowl for supporting a user's weight, which become stained by yellowish or black stuffs. Such stains are more noticeable in case of a vacuum toilet system configured to flush waste in a lid-closed condition, compared to a case of the same, but configured to flush waste in a lid-open condition. Passenger aircraft operating companies or attendants of such companies admit such problem and point out that these stains are persistent and hard to remove.

It may be easily considered that the cause of the stain is related to the vacuum sucking operation under a lid-closed condition. It is known in a vacuum toilet system that a large amount of air flows into the bowl simultaneously when the waste is sucked by vacuum. Since such air flow is generated instantly together with sucking operation, the air flow channel is blocked by the closed lid, which generates vacuum pressure inside the bowl. This causes disturbance of air flow and creates a vortex inside the bowl, and it can be considered that such phenomenon scatters the waste or residue located inside the bowl, even if it is a small volume. Another possibility is that it is known that when a male urinates, it is almost unavoidable to scatter urine around the bowl, even it is a small volume. Not limited to a male only, but also when the toilet is used in a shroud-closed condition, similar phenomena may take place. Such urine or fecal waste scattered on the surface of the bowl may be scattered again when the toilet is used next time under the shroud-closed and lid-closed conditions by the air, which flows fast through a narrow gap between the bowl and the shroud when the waste is sucked by vacuum, which scattered waste sticks especially to the area around the stays of the shroud where air flow is disturbed. Generally, if urine waste sticks to the surface, it turns into urolith, which becomes a stain hard remove.

Such operation of flushing waste after the lid of the toilet is closed is a system that is adopted rather recently. As far as the present inventor knows, such system was employed first in the Boeing 787, in case of a commercial aircraft, and such a system was not known in any aircrafts prior to this. It may be admitted that such an idea of flushing waste after the toilet is used in a lid-closed condition, or an idea of automatically closing a lid and flushing waste upon operation of a flush button is a new technology taking amenity and convenience at the time of using a toilet into consideration. However, it is assumed that the total system of a vacuum toilet system as a whole, including shroud and lid, was not properly considered when employing such a new system. It can be said that such a stain on a vacuum toilet system makes users uncomfortable, and cannot be accepted by users, especially for the case of a modern aircraft that is designed to provide comfort of flight to passengers.

The object of the present invention is to propose a means for solving the problem of stains on a vacuum toilet system as described above, which is desired to be solved at earliest possible timing.

The present invention is intended to solve the above mentioned problem existing in the prior art by avoiding formation of a vortex generated by vacuum pressure at the time of the vacuum sucking process by providing sufficient air flow space so as to smoothly introduce air into the bowl even when the lid of the toilet is closed. More specifically, the present invention includes the following.

One aspect of the present invention relates to a vacuum toilet system comprising a lid, a shroud, a bowl, and a vacuum sucking device for flushing waste, characterized in that:

in order to make easier flow-in of air into the bowl at the time of flushing in a lid-closed condition over the bowl, the lid is structured in a form of either:

i) having openings on its upper surface in a mesh configuration or a slit configuration for allowing air flow in and preventing a drop of foreign stuffs into the bowl, ii) having openings of an air scoop configuration for introducing air flow, iii) creating an average gap of at least about 5 mm between the lower surface of the lid and the upper surface of the shroud in the lid-closed condition, or iv) having a mechanism for automatically operating flush before the lid is completely closed by detecting the lid when it reaches a predetermined angle of inclination just before it closes.

Another aspect of the present invention relates to a vacuum toilet system comprising a lid, a shroud, a bowl, and a vacuum sucking device for flushing waste, characterized in that:

in order to make easier flow-in of air into the bowl at the time of flushing in a lid-closed condition over the bowl, the lower surface of the shroud opposite the upper surface of the bowl is structured in a form of either:

i) having a curved cross-section for keeping the center portion of the lower surface away from the upper surface of the bowl all around a rim of the bowl, ii) having a plurality of shroud stays projecting smoothly in a wavy form for supporting weight imposed on the shroud by contacting to the upper surface of the bowl when the shroud is in closed condition, or iii) having a plurality of shroud stays for creating an average gap of at least about 25 mm between the upper surface of the bowl and the lower surface of the shroud when the shroud is in closed condition, Yet another aspect of the present invention relates to a vacuum toilet system comprising a lid, a shroud, a bowl, and a vacuum sucking device for flushing waste, characterized in that:

in order to make easier flow-in of air into the bowl at the time of flushing waste in a lid-closed condition over the bowl, the upper surface of the bowl has protrusions projecting smoothly in a wavy manner from the surface at portions opposite to shroud stays formed to the lower surface of the shroud, so as to create an average gap of at least 25 mm between the upper surface of the bowl and the lower surface of the shroud when the shroud is in a closed condition.

By implementing the present invention, advantageous effect may be achieved, such as preventing stains of a vacuum toilet system through avoiding generation of a vortex by enabling a necessary volume of air to be drawn into the bowl at the time of flushing, even in a condition of the lid of a vacuum toilet system being closed, or just before it closes.

The following reference numbers are used in the Figures: 1: vacuum toilet system, 10: bowl, 11*a*: protrusion, 20 shroud, 21: upper surface, 22, 22*a*: shroud lower surface, 23: shroud stay, 30: lid, 31, 33: opening, 34: stopper, 40: vacuum sucking device, 50: lid closing lever.

DETAILED DESCRIPTION

Figure 1A:
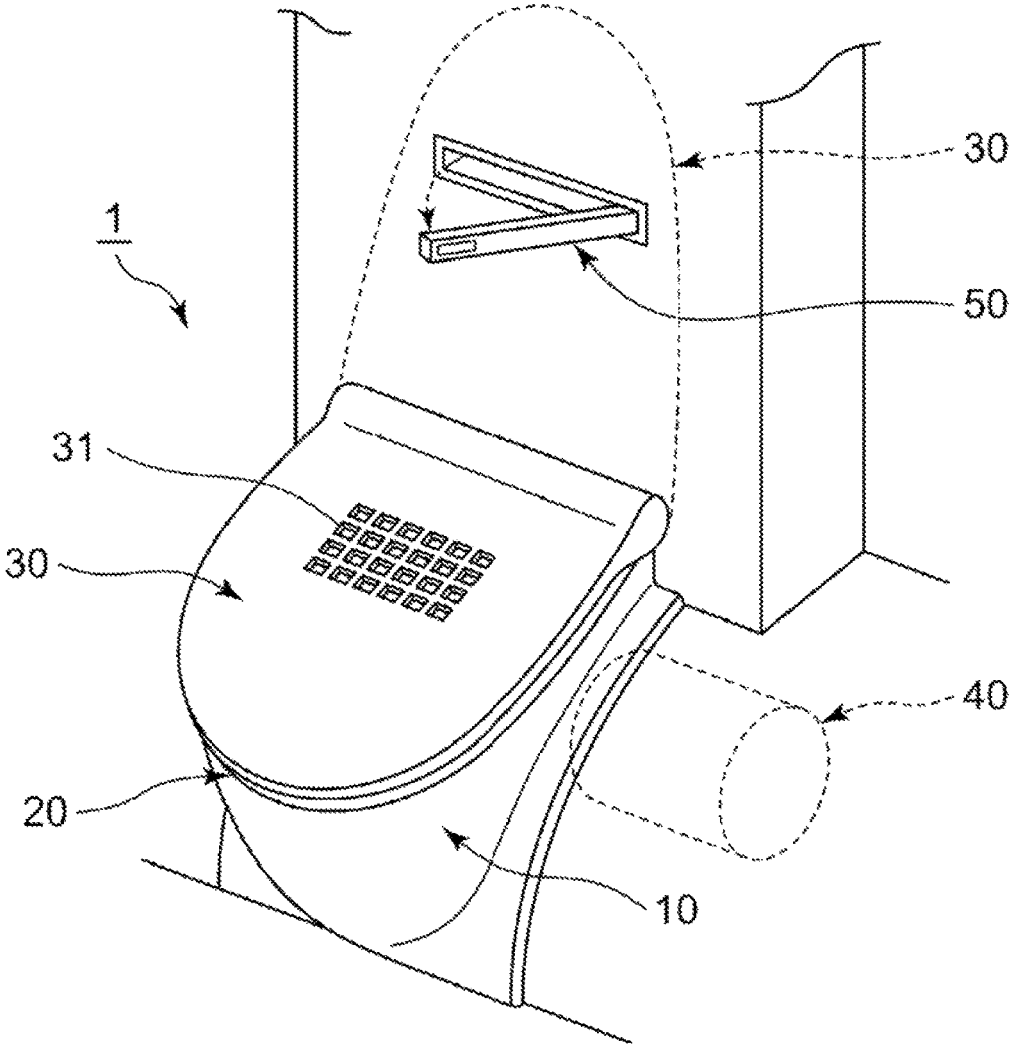
FIGS. 1*a* and 1*b* are perspective views showing the vacuum toilet system according to embodiments of the present invention.

The first embodiment of a vacuum toilet system according to the present invention is now described by referring to appended drawings. The present embodiment is directed to an improvement of a "lid" of a vacuum toilet system, and FIG. 1 shows a specific example of such an improvement. By referring to FIG. 1*a*, the vacuum toilet system 1 is mainly structured by a bowl 10, a shroud 20, a lid 30, and a vacuum sucking device 40. In the drawing, the vacuum sucking device 40 is hidden behind and shown by dotted lines. Such basic structure is the same for other embodiments to be described below. Although not shown in the drawing, a flushing button to be operated after usage of the toilet is located at any of an appropriate position. In the drawing, the shroud 20 and the lid 30 are both in a closed position over the bowl 10.

In the case of modern aircrafts, a lid closing lever 50 is provided behind the lid 30 when it opens, which lever 50 is designed to push the lid 30 from behind when it opens. The lid closing lever 50 pushes the lid 30 from its open position to semi-closed position past a vertical angle of inclination of the lid 30, and the lid 30 then moves downward to a closed position gradually by means of a damper. When a censor detects that the lid 30 is completely closed, a signal from the censor is transmitted, which becomes a trigger of automatic flushing operation. It is said that the reason for operating flush after the lid 30 is closed as described above is to prevent dropping of foreign stuffs into the bowl 10 (unintentional dropping of foreign stuffs by a user), to provide safety, and to mitigate as much as possible any unpleasant noise (impact sound of vacuum) created at the time of vacuum sucking.

In the present embodiment, as shown in FIG. 1*a*, openings 31 are formed on the lid 30, through which air passes into the bowl 10 at the time of vacuum sucking (flushing). According to prior art toilet systems where no such openings are provided, as the shroud 20 and the lid 30 are tightly closed over the bowl 10 as shown in the drawing, inflow of air at the instance of vacuum sucking is disturbed, thereby vacuum pressure is created inside the bowl 10, which may create a vortex and cause stains of the shroud 20 and others. In case of the vacuum toilet system 1 according to the present embodiment, since air can flow through the opening 31 into the bowl 10, whereby momentary vacuum creation inside the bowl 10 can be avoided, which in turn condition for preventing build-up of stains can be created.

Although the openings 31 are depicted in a mesh (reticulated pattern) configuration of square holes in the drawing, total areas of the openings may properly be determined based on volume of the bowl, shape of the same, location of the openings 31, and/or sucking vacuum pressure, etc. Further, mesh configuration as shown in the drawing may prevent dropping of foreign stuffs into the bowl, which may happen in case of having a large-sized opening(s), but as far as such prevention is achieved, any configuration of the openings may be employed, which includes, but is not limited to a plurality of slits, circular holes, other types of mesh configuration etc. Since the lid 30 is normally made by plastic injection process, it is desirable to form the openings in one piece with the lid 30 rather than assembling separated components having the openings. It is easier to produce if it is formed in one piece component, and substantial cost difference may not be achieved relative to the lid without having openings, except for die producing cost.

Figure 1B:
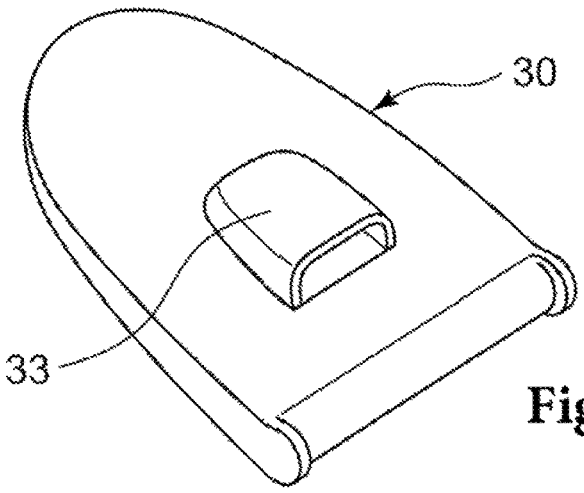

FIG. 1*b* shows another aspect of an improvement of the lid 30, in which the opening 33 is formed in an air scoop shape. An air scoop is generally used for introducing ambient air into machinery etc., such as automobiles, aircrafts, or ships, which is formed on their outer surface in a projected manner. The opening 33 in this case may have a similar shape to such an air scoop. By forming the opening 33 in an air scoop shape, the upper surface of the lid 30 when in a closed condition resembles that of the conventional lid, which may more effectively prevent dropping of foreign staffs into the bowl, and cost increase may be avoided by forming it in a single piece with the lid.

It is desirable to have a direct opening of the air scoop 33 opposite to the hinged portion of the lid 30 as shown in the drawing. The reason for this is that since the opening is directed opposite to a user, careless dropping of foreign stuffs may be more securely prevented. Further, impact noise due to vacuum sucking may also be diminished to a certain level. Some level of impact noise of vacuum sucking compared to the lid without having such openings is inevitable due to forming air scoop hole on the lid 30. However, since it may take about 10 seconds or so until the lid 30 completely covers the bowl after the flush button is operated, and the user may leave from the toilet system area during this time, it may be said that the present system in which flushing takes place after closing the lid 30 may decrease the negative effect of noise compared to the prior art toilet in which flushing takes place immediately after operation of the flush button.

Figure 2:
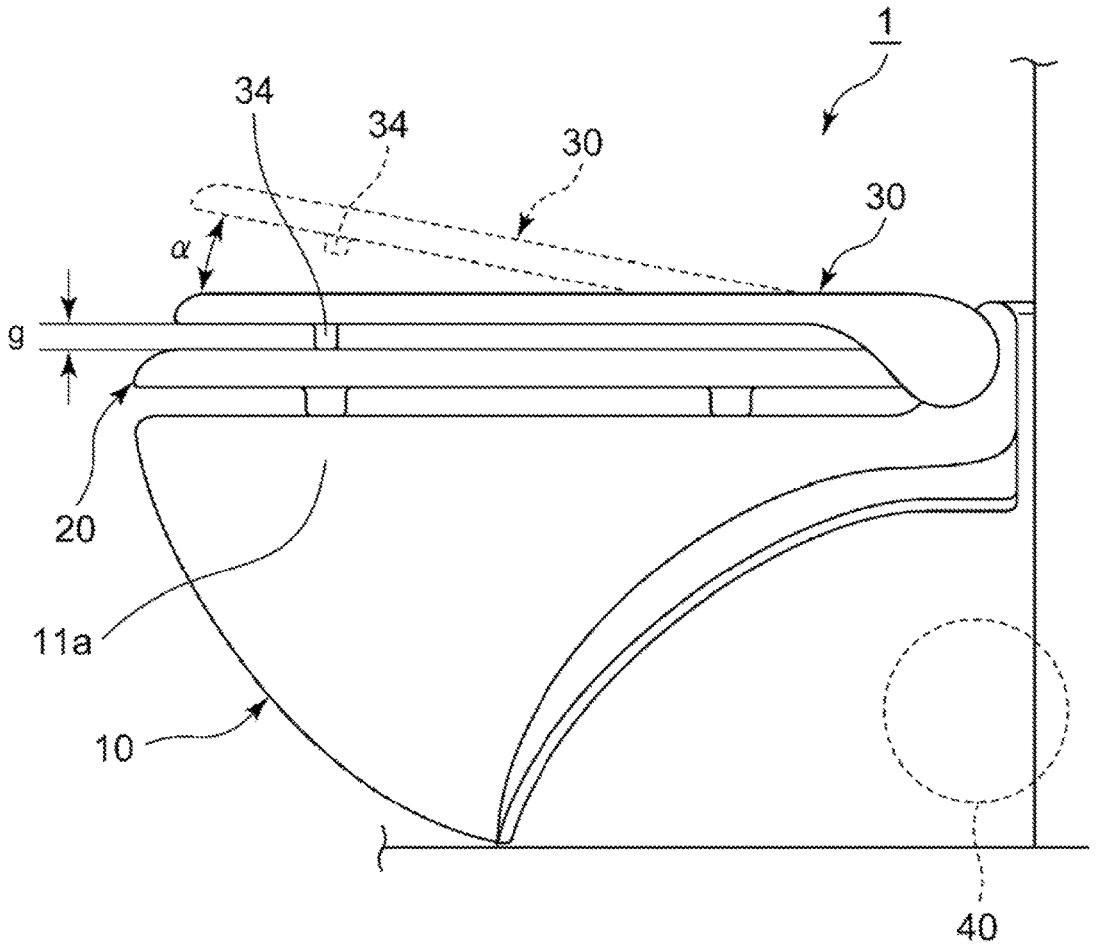
FIG. 2 is a side view showing the vacuum toilet system according to another aspect of the embodiment shown in FIG. 1.

FIG. 2 shows yet another aspect of the present embodiment. Referring to the drawing, normally a pair of stoppers 34 are provided on the right and left sides of the bottom surface of the lid 30 for supporting the lid 30 when it is closed onto the shroud 20. Since no significant weight load is to be imposed on the lid 30 itself, generally simple types of stoppers 34, such as rubber in a bar shape, are provided, which creates a gap "g" of about 5 mm or so between the lid 30 and the shroud 20. In the present embodiment, the height of the stopper is elongated to at least about 10 mm or so, which increases height about 5 mm, and more desirably, it is elongated to 15 mm or so, which increases height about 10 mm compared to those in prior art. The hinged portion of the lid 30 may also be raised corresponding to such height increase, so that the lid 30 becomes horizontal when it is closed. However, it is also possible not to raise the hinge portion, but to more increase the extension level of the stopper, so that average gap between the lid 30 and the shroud 20 becomes at least 10 mm or so, or more desirably 15 mm or so in a lid 30 inclined condition. The gap described above may properly be adjusted based on total volume of the bowl, its shape and/or level of sucking vacuum pressure.

The lid 30 depicted by a dotted line in FIG. 2 shows yet another aspect of the present embodiment. In this aspect, it is structured that a censor detects closing motion of the lid 30 before it completely closes the shroud 20, and when the lid 30 reaches a predetermined angle of inclination, the censor transmits a signal for triggering operation of the vacuum sucking device 40. Since the lid 30 gradually closes by the effect of a damper, flushing operation may be finished before the lid 30 completely closes. Through such arrangement, air may easily flow into the bowl beneath the lid 30 until it is completely closed. Such predetermined angle of inclination of the lid 30 may properly be selected based on volume of the bowl, its shape, and/or level of sucking vacuum pressure, etc.

Figure 3A:
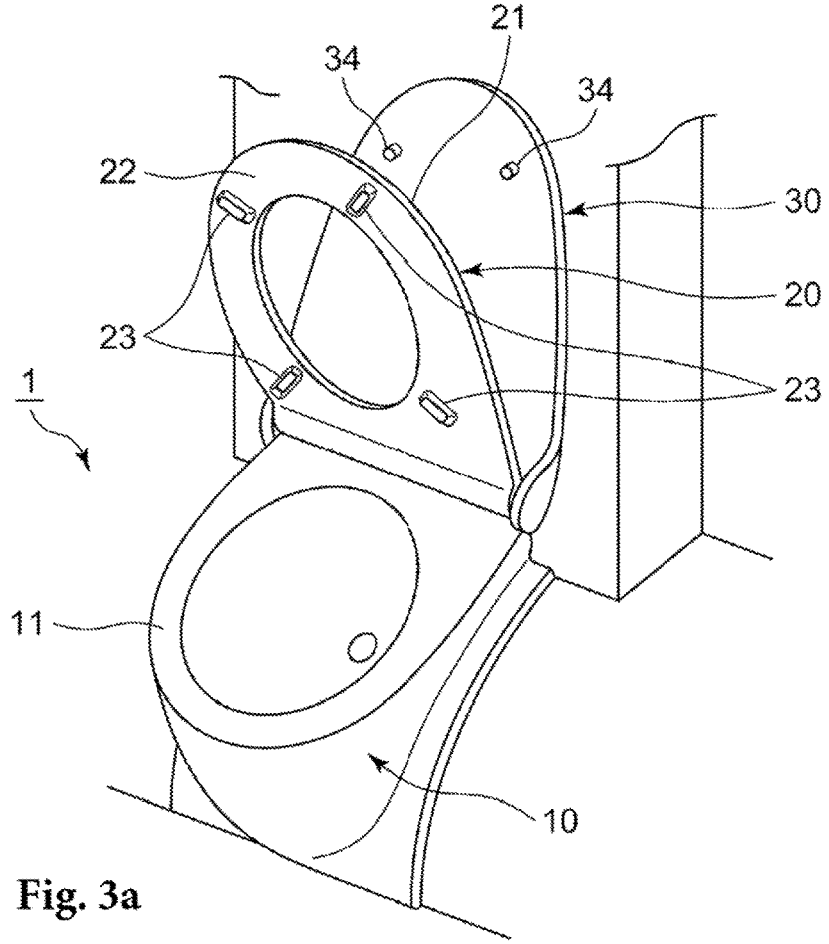
FIG. 3*a* is a perspective view showing the vacuum toilet system according to another embodiment of the present invention.

Next, the second embodiment of the vacuum toilet system according to the present invention is now being described by referring to appended drawings. The present embodiment as shown in FIG. 3 is directed to an improvement of a "shroud" of the vacuum toilet system, and the drawing shows an example of such improvement. FIG. 3*a* shows the vacuum toilet system 1 wherein both of the shroud 20 and the lid 30 are in open position. Referring to the drawing, the shroud 20 is generally structured by an upper surface 21 which is in blind side in the drawing and the lower surface 22 which covers the upper surface 11 of the bowl 10 when it is in a closed position. These two elements may be combined into one component as a single piece. A plurality of shroud stays 23 (four of them are shown in the drawing) are provided on the lower surface 22 for supporting the weight of a user sitting on the shroud 20.

Figure 3B:
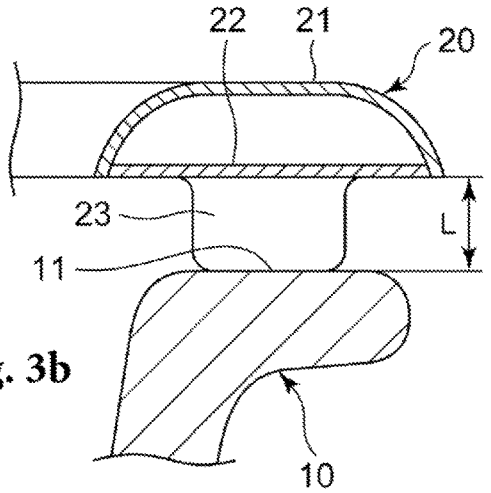
FIGS. 3*b* and 3*c* are cross-sectional views of the vacuum toilet system according to other embodiments of the present invention.

When vacuum sucking is operated in a condition of both the shroud 20 and the lid 30 being closed, most of ambient air passes through the narrow gap between the upper surface 11 of the bowl 10 and the lower surface 21 of the shroud 20. As described above, such throttle effect of the air flow causes generation of a vortex, which is considered as a cause of scattering waste to form stains. Such stains are more evident in the area surrounding the shroud stays 23 where air flow is blocked. In one aspect of the present embodiment, formation of vacuum pressure inside the bowl 10 is diminished to its utmost by reducing disturbance of the air flow by increasing height "L" of the shroud stays 23 as shown in FIG. 3*b*. The height "L" of the shroud stays 23 in prior art is about 10 mm or about 15 mm at most, but a wider gap between the bowl and the shroud may be created by increasing the height. The level of such height increase may vary depending on level of sucking vacuum pressure and/or volume and shape of the bowl, but one example of the increase of the height is at least 5 mm so as to make height L 20 mm, and more desirably increase by 10 mm so as to make height L 25 mm. In such an instance, it is desirable to adjust the height of the hinge portion of the shroud 20 as well, so that the shroud 20 becomes horizontal when it is closed. However, the shroud can be in an inclined condition in a similar manner as described for the case of the lid 30 above, so that the above-mentioned gap may be achieved in average.

Figure 3C:
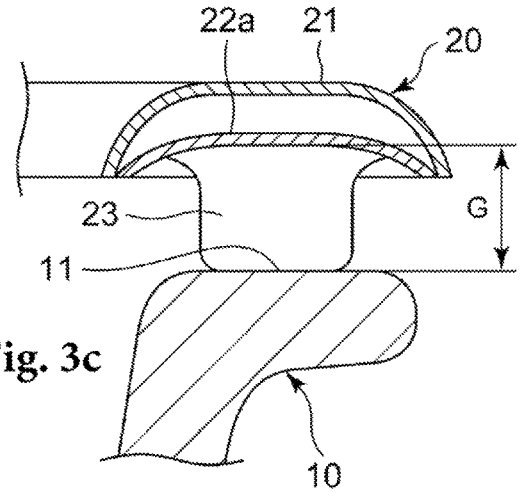

FIG. 3*c* shows yet another aspect of an improvement of the shroud according to the present embodiment. Generally, the shroud 20 is configured to have wider area compared to the upper surface 11 of the bowl, so that the shroud 20 may completely cover the upper surface 11 of the bowl 10. In the prior art, the shroud lower surface 22 is formed in a flat shape in its cross-section as shown in FIG. 3*b*, which opposes the upper surface 11 of the bowl 10 in a slightly curved shape in its cross-section. Because of such arrangement, air flow introduced from ambient atmosphere is throttled at such a narrow gap portion, which causes disturbance against air flow and generation of vacuum pressure. In the configuration shown in FIG. 3*c*, the shroud lower surface 22*a* has a curved shape in its cross-section along with the upper surface 11 of the bowl 10 in such a manner that the center of the section of the upper surface 11 separates away from the upper surface 11, so that constant gap "G" relative to the upper surface 11 of the bowl 10 can be maintained. Size of the gap "G" may vary depending on level of sucking vacuum pressure and/or volume and shape of the bowl, but one example is to achieve at least about 20 mm or so all through the gap between the outside of the bowl and the inside the same, and more desirably, to achieve about 25 mm or more.

In some cases, a heating coil may be disposed in a cavity between the upper surface 21 and the lower surface 22*a* of the shroud 20, but such space may be secured even when curbed shape of the lower surface 22*a* is employed by properly arranging such shape. Shroud stays 23 in prior art are integrally formed with the lower surface 22, and such arrangement may also be possible even when the lower surface 22*a* is curved as the case of the present embodiment. In this instance, build-up of stains may effectively be prevented by forming the shroud stays 23 having a smooth surface and by projecting them smoothly from the lower surface 22*a*. In some cases in the prior art, a cushion rubber is added to the tip of the shroud stay 23, but similar arrangement can be adopted for the case of the present embodiment. Although FIGS. 3*b* and 3*c* are shown as independent embodiments, they may be combined and implemented together.

Figure 4:
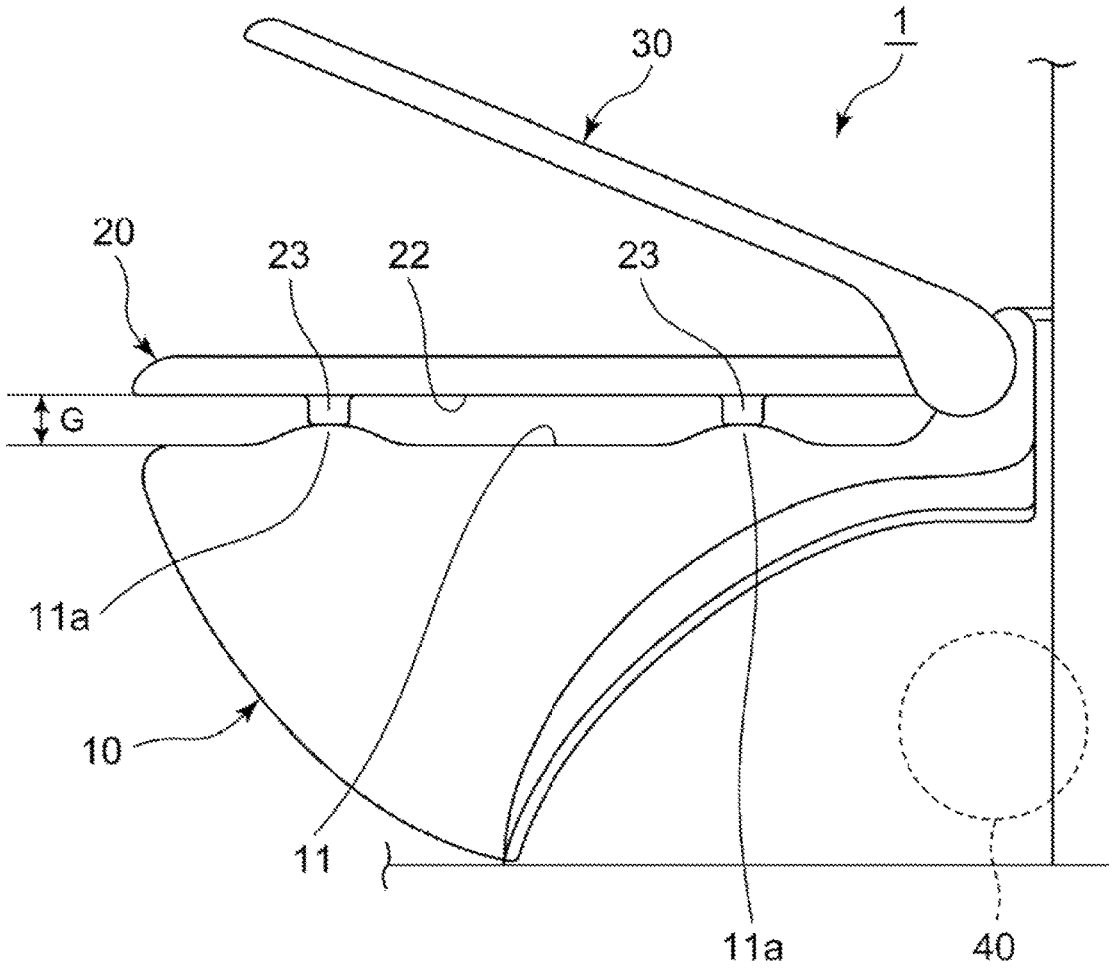
FIG. 4 is a side view showing the vacuum toilet system according to yet another embodiment of the present invention.

Next, the third embodiment of the vacuum toilet system according to the present invention is now being described by referring to appended drawings. The embodiment shown in FIG. 4 is directed to an improvement of the "bowl" of the vacuum toilet system, and the drawing shows one aspect of the embodiment. In prior art, the surface 11 of the bowl 10 is curved in its cross-sectional view, but height of the surface in circular direction is constant, which means the upper surface 11 is flat from that perspective. Contrary to this, in the vacuum toilet system 1 according to the present embodiment, the height in circular direction of the surface 11 of the bowl 10 varies as shown in FIG. 4, and more specifically, portions of the surface opposite to and contacting with the shroud stays 23 extending from the shroud lower surface 22 when the shroud is closed have protrusions 11*a* projecting upwardly from the surface 11. The protrusions 11*a* are desired to be formed smoothly projecting from the circular upper surface 11 of the bowl in wavy manner, so that it has a configuration preventing build-up of stains around these portions.

Height of the protrusions 11*a* extending from the surface 11 of the bowl 10 may vary depending on level of sucking vacuum pressure and/or volume and shape of the bowl, but one example is that the height is arranged to increase of a gap G between the bowl upper surface 11 and the shroud lower surface 22 at least 5 mm so as to achieve about 20 mm in total gap, and more desirably increase about 10 mm so as to achieve 25 mm in total. Such arrangement may make air flow from outside to inside of the bowl 10 easier, which in turn prevents build-up of stains around these portions.

Although not shown in the drawing, similar smoothly protruding arrangement in a wavy configuration may be formed on the shroud lower surface 22 rather than the upper surface 11 of the bowl 10. Namely, shroud stays 23 are formed in a wavy configuration extending downwardly from the shroud lower surface 22 while maintaining the upper surface 11 of the bowl 10 in a flat shape in its circular direction, which also makes air flow smooth and effectively prevents build-up of stains. It would be further desirable to make the height of the protrusions even higher than the conventional shroud stays 23, so as to increase the gap G by at least 5 mm, and more desirable by at least 10 mm, which would more effectively prevent build-up of stains. In addition to such an arrangement, it is also possible to form protrusions on the upper surface 11 of the bowl as well, as shown in FIG. 4.

As described in each of the embodiments according to the present invention, stains on the lower side of a shroud become more obvious when flush is operated after the lid is closed, compared to the case where flush is operated before the lid is closed. The main reason for this is assumed that air freely flows from overall upper side of the bowl when the lid is open is blocked when the lid is closed. Therefore, improvement could be made if similar condition of a lid-open position is achieved even in a lid-closed position. In the above embodiments, arrangement is made to achieve the gap between the bowl upper surface and shroud lower surface of at least about 20 mm, more desirably about 25 mm or more, so as to become closer to the condition of the prior art where the gap is about 10 mm or 15 mm at most, but the lid is open when operating flush. Similarly, to achieve the gap between the shroud and the lid of at least about 10 mm, and more desirably about 15 mm, compared to the gap of 5 mm in prior art. Such level may vary depending on volume or shape of the bowl and/or level of sucking vacuum pressure, which may be determined by considering balance of noise, formation of odor, and/or safety requirements.

In the above vacuum toilet system according to each of the embodiments of the present invention, description is made under the condition that the lid automatically closes upon operation of the flushing button, and the flush is triggered automatically when the lid is closed. The present invention is not limited to such arrangement, but it may be employed to the vacuum toilet system of prior art where flushing operation and closing lid are manually operated. It is because the user may first close the lid and then operate the flush button even in such manually operated vacuum toilet system.

The vacuum toilet system according to the present invention may be widely used in the industrial fields of manufacturing, selling, and utilizing the vacuum toilet, especially in the industrial field of operating aircrafts, ships and vehicles, as well as performing maintenance activities of the same.

What is claimed is:

1. A vacuum toilet system comprising a bowl to collect waste;

a shroud pivotally connected to the bowl to enable a user to sit thereon, wherein a first gap is located between the bowl and the shroud when the shroud is in a closed configuration and air can traverse through the first gap;

a lid pivotally connected to the bowl over the shroud, wherein a second gap is located between the shroud and the lid when the lid is in a closed configuration and air can traverse through the second gap, wherein the lid includes at least one opening formed in an upper surface thereof, wherein the at least one opening is to allow air to traverse therethrough and prevent objects from falling therethrough; and a vacuum sucking device configured to operate when the lid is in a closed configuration for flushing waste, wherein a combination of the first gap, the second gap and the at least one opening in the lid are capable of introducing sufficient air into the bowl when flush is operated to prevent a vortex from being created therein.

2. The system of claim 1, wherein the at least one opening includes a plurality of small openings in a mesh configuration.

3. The system of claim 1, wherein the at least one opening includes a plurality of slits.

4. The system of claim 1, wherein the at least one opening includes an air scoop.

5. The system of claim 4, wherein the air scoop has an opening facing a back of the system.

6. The system of claim 1, wherein the shroud includes stoppers to provide room for air flow between the shroud and the bowl.

7. The system of claim 6, wherein the shroud includes a curved bottom surface.

8. The system of claim 6, wherein the bowl has raised portions on an upper surface in alignment with the shroud stoppers.

9. The system of claim 6, wherein the shroud has raised portions on a lower surface in alignment with the shroud stoppers.

10. The system of claim 1, wherein the lid includes stoppers to provide room for air flow between the lid and the shroud.

11. The system of claim 1, further comprising a lid closing lever that is activated to engage the lid when the vacuum sucking device is activated by a user so that the lid is in a closed configuration when the vacuum sucking device is operational.

12. The system of claim 11, further comprising a flushing button to activate the vacuum sucking device.

13. The system of claim 12, further comprising a sensor to determine when the lid is in the closed configuration and to operate the vacuum sucking device.

14. The system of claim 13, wherein the sensor is to determine the lid is in the closed configuration when it substantially touches the shroud.

15. The system of claim 13, wherein the sensor is to determine the lid is in the closed configuration when the lid is a defined angle from the shroud.

16. The system of claim 15, wherein operating the vacuum sucking device when the lid reaches the defined angle provides additional airflow.

17. The system of claim 1, wherein the lid is a single component that is formed with the at least one opening therein.

* * * * *